United States Patent [19]

Burwasser et al.

[11] 4,112,172

[45] Sep. 5, 1978

[54] DIELECTRIC IMAGING MEMBER

[75] Inventors: Herman Burwasser, Boonton; John R. Wyhof, Wanaque, both of N.J.

[73] Assignee: GAF Corporation, New York, N.Y.

[21] Appl. No.: 718,361

[22] Filed: Aug. 27, 1976

Related U.S. Application Data

[63] Continuation-in-part of Ser. No. 669,675, Mar. 23, 1976, abandoned.

[51] Int. Cl.[2] ..... G03G 7/00

[52] U.S. Cl. ..... 428/215; 428/336; 428/337; 428/339; 428/412; 428/458; 428/483; 428/520; 427/123; 427/58; 427/407 G; 96/1 TE; 355/3 R

[58] Field of Search ..... 427/121, 58, 79, 80, 427/81, 124, 123, 14, 407 G; 96/1 TE, 1 R, 1.4; 428/215, 337, 336, 339, 480, 500, 412, 458, 483, 520; 355/3 R

[56] References Cited

U.S. PATENT DOCUMENTS

| | | | |
|---|---|---|---|
| 3,252,830 | 5/1966 | Cummin et al. | 427/79 X |
| 3,619,054 | 11/1971 | Goffe | 96/1 TE |
| 3,639,640 | 2/1972 | Gager | 427/121 |
| 3,672,930 | 6/1972 | Trachtenberg | 96/1 TE |
| 3,997,343 | 12/1976 | Weigl et al. | 427/14 X |
| 4,015,043 | 3/1977 | Watanabe et al. | 427/121 X |

*Primary Examiner*—Ralph S. Kendall
*Attorney, Agent, or Firm*—Walter C. Kehm; Walter Katz

[57] ABSTRACT

An improved dielectric imaging member comprising a transparent dielectric substrate having a thickness of between about 75 - 175 micrometers, a conductive layer on said substrate and a dielectric material having a thickness of less than about 15 micrometers on said conductive layer. An imaging process is also provided comprising generating an electrostatic latent image on said dielectric imaging member and developing said image by contact with a developer material.

5 Claims, 3 Drawing Figures

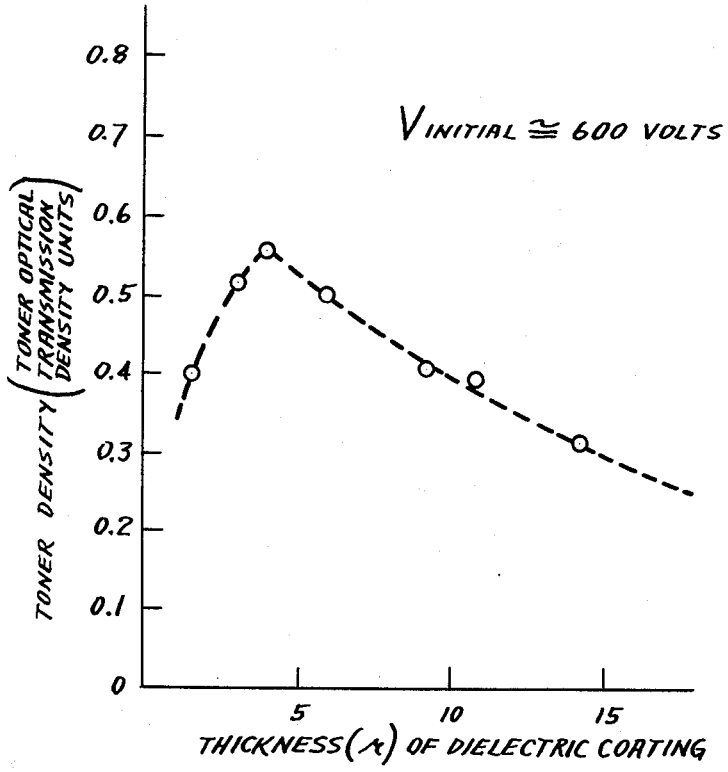
Fig. 2.
Fig. 3.
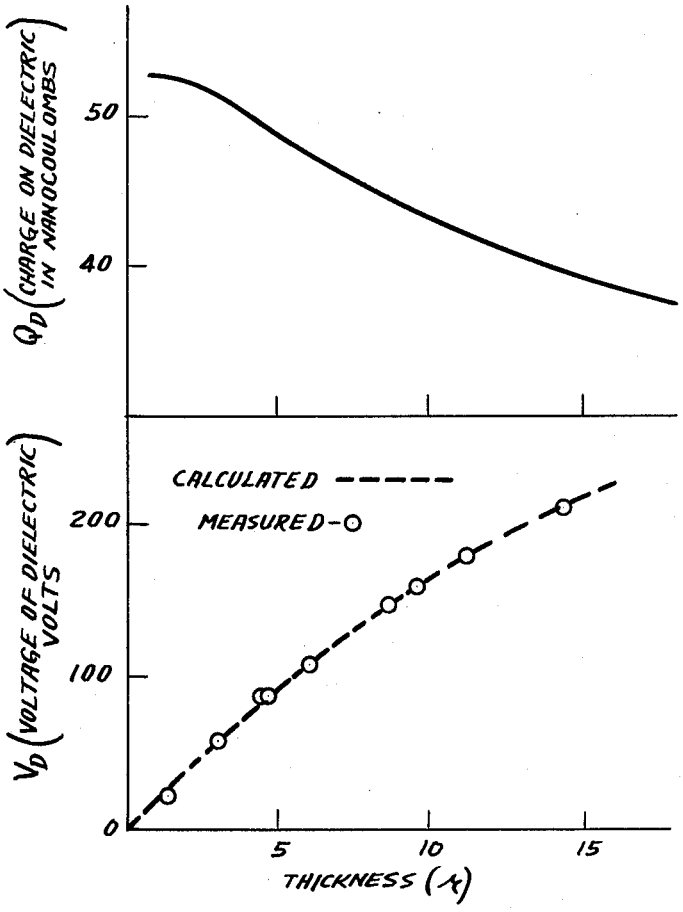

DIELECTRIC IMAGING MEMBER

CROSS-REFERENCE TO RELATED APPLICATION

This application is a continuation-in-part of copending application Ser. No. 669675 filed Mar. 23, 1976, abandoned.

BACKGROUND OF THE INVENTION

1. Field of the Invention

This invention relates to a dielectric imaging member and processes for producing an image on a dielectric imaging member, such as polyester film.

2. Description of the Prior Art

Images can be reproduced on a dielectric surface through various electrostatographic processes. In one such process, an electrostatic latent image is generated on the dielectric from a metallic electrode or pin by air ionization. Other such processes involve the transfer of an electrostatic latent image to a dielectric surface after it has been formed either on a dielectric surface or on a photoconductive surface.

In the first such process, generally referred to as electrography, electrostatic latent images are generated by character shaped electrodes or pin electrodes which are brought into close proximity to an insulating surface, such as a dielectric web, supported on a base electrode. A potential is applied across the electrodes below a critical stress value. Transfer of the character or pin configuration from the electrode to the insulating web is effected by the use of a relatively low potential triggering pulse which raises the electric field above the critical stress value to produce a field discharge in the space between the insulating web and the electrode. The discharge action gives rise to the formation of an electrostatic latent image of the character or pin on the insultating web. Thereafter, the generated image on the insulating web can be rendered visible by application of liquid or dry developer thereto.

Electrography is useful in many applications where it is required that a voltage signal pulse be applied directly to a dielectric receiving member, e.g., analog oscillographs, high speed line printers, digital plotters and the like. Typical requirements for such systems are pulses of 700 volts in 50 to 100 microseconds.

It has been found, however, that application of electrographic techniques to dielectric films of finite thickness, e.g., polyester films having a thickness of greater than 75 micrometers, results in a low density, diffuse image that requires relatively high voltage pulses in the millisecond range.

In the basic electrostatographic process, a uniform electrostatic charge is deposited upon a photoconductive insulating layer which is thereafter exposed to a light image to selectively dissipate charge in those areas of the layer exposed to the light, thereby forming an electrostatic latent image. The image can be developed by depositing a viewable toner thereon. Alternatively, the latent image can be transferred to a dielectric surface for subsequent development. Still further, the latent image formed upon dielectric surface either by electrographic techniques or transfer techniques as described above can, in turn, be transferred to a dielectric surface. Techniques for transferring electrostatic latent images to an insulating surface are well known in the art and have been accorded the acronym TESI (Transfer of ElectroStatic Image) — see, for example, *Xerography And Related Processes,* Dessauer and Clark, The Focal Press (1965) pp. 405 et seq.

If desired, the latent image on the photoconductor can be developed directly and the developed areas can then be transferred by placing an insulating surface over the developed photoreceptor surface and applying thereto a high potential of opposite polarity to that of the developer by, for example, corona discharge. When the insulating surface is peeled away from the photoreceptor, it will carry thereon a sizeable portion of the developer in image configuration. When transfer is accomplished, the developer can be fixed by fusing it to the receiving surface or by other conventional fixing means.

When the electrostatic latent image is transferred from the photoconductor surface to a dielectric surface before development, the charged photoconductive surface is brought into intimate contact with the dielectric surface to effect charge transfer or transfer can occur across an air gap by impressing a voltage between a conductive backing on the photoconductor and the opposed dielectric surface of a polarity to attract the charge on the imaged areas to the dielectric.

As a practical matter, however, it has heretofore been impossible to transfer charge from a photoconductor to a thick e.g., 75 micrometers or greater, dielectric film and subsequently develop the image to a high optical density with conventional systems.

Accordingly, it is an object of the present invention to provide an improved dielectric film which can be readily imaged using various electrostatographic techniques to provide high density, sharp images.

It is another object of the present invention to provide a dielectric film having a thickness greater than about 75 micrometers which can be electrographically imaged and result in the formation of high optical density, sharp images.

It is a still further object to provide improved microimaging systems.

These as well as other objects are accomplished by the improved dielectric member of the present invention which comprises a dielectric substrate having a thickness between about 75 and 175 micrometers, a conductive coating on said substrate and a dielectric material having a thickness less than about 15 micrometers overcoating said conductive coating.

Transparent polyester films are presently used as the preferred base material, for example, in micrographics, due to their strength and stability. To permit process manipulation and handling, these polyester films are typically about 75–175 micrometers thick. Accordingly, reproduction processes based on the generation of an electrostatic latent image on such dielectric substrates were heretofore unavailable for use in conjunction with such preferred, but relatively thick substrates.

SUMMARY OF THE INVENTION

From known relations such as $C = Q/V$, and C is proportionate to 1/t, where $C$ = capacitance of the dielectric film, $Q$ = surface charge density, $V$ = surface voltate of the charge and $t$ = film thickness, it is known that thin films will store more electrostatic charge, albeit at the expense of surface voltage.

Therefore, in order to obtain optimum image density on a dielectric imaging member comprising a dielectric substrate having a thickness of about 75–175 micrometers, it has been discovered that if a second dielectric layer of less than 15 micrometers is applied to the dielectric substrate over a thin layer of a conductive agent, the capacitance of the resultant dielectric imaging member is changed relative to the charged photoconductor or an electrographic electrode to retain high charge density of an electrostatic latent image generated on the resultant dielectric imaging member. The generated image can be conventionally developed with high resolution. To the observer, however, the original dielectric imaging member remains virtually unchanged as far as transparency and thickness is concerned.

BRIEF DESCRIPTION OF THE DRAWING

Further objects and advantages of the invention will become more apparent from the following description and claims, and from the accompanying drawing, wherein:

FIG. 2 is a graph illustrating the experimental results obtained by coating a conductively treated polyester film with a dielectric of various thicknesses and the developer density obtained on development of an electrostatic latent image transferred to the film; and FIG. 3 is a composite graph of both the surface voltage and charge density of an electrostatic latent image transferred to a dielectric coating of various thickness which is applied to the conductively treated polyester film.

DETAILED DESCRIPTION OF THE PREFERRED EMBODIMENT

Figure 1:
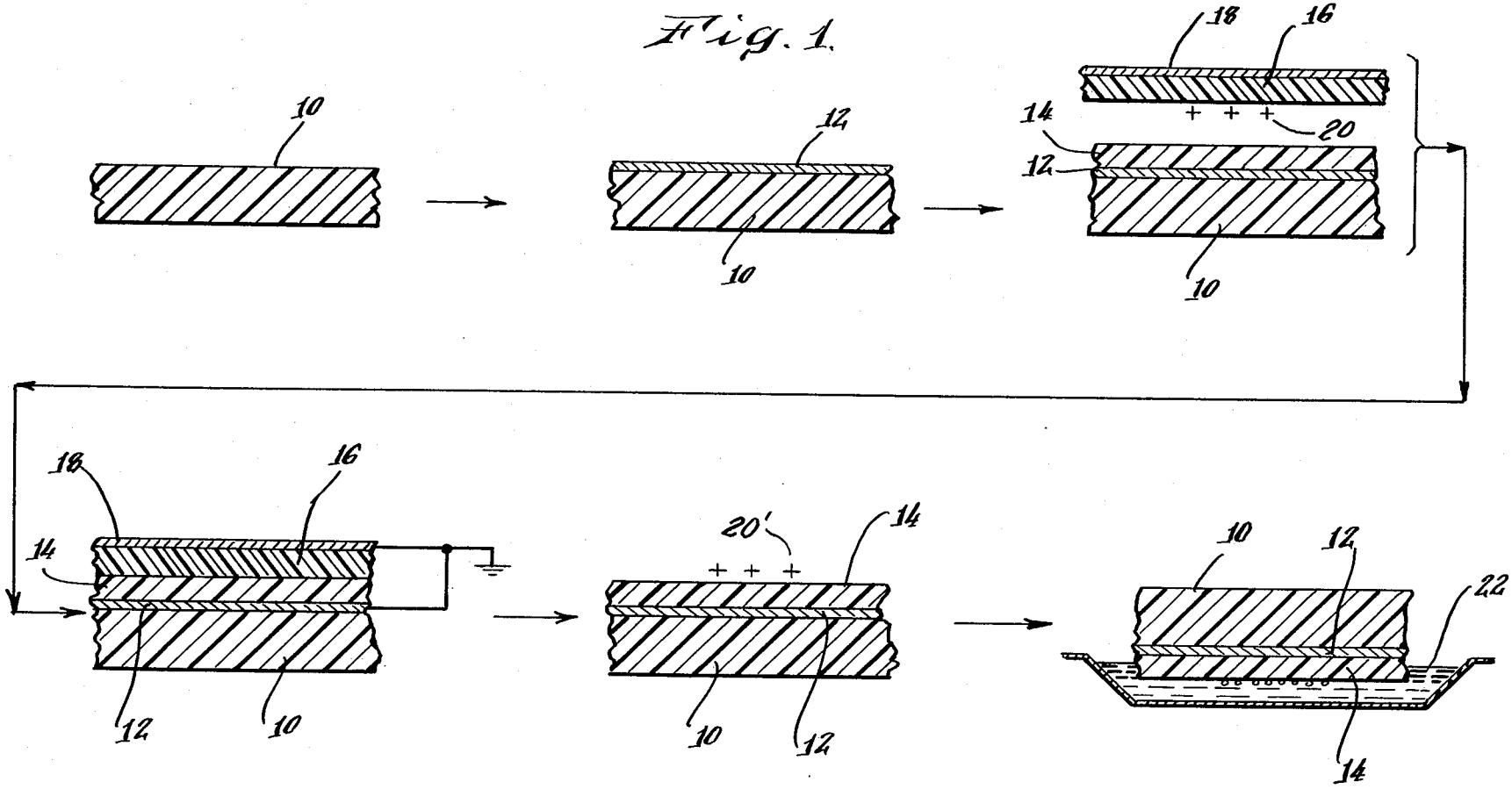
FIG. 1 is a diagrammatic view illustrating the process steps of one aspect of the present invention.

Referring now to the drawings in detail, wherein like numerals indicate like elements, the process of the present invention is illustrated in FIG. 1.

A typical 75–175 micrometers transparent dielectric substrate 10 has a thin transparent electrically conductive layer 12 applied to its surface. Conductive layer 12 has a resistivity value of less than $10^{10}$ Ω/square, and preferably less than $10^{8}$ ⅝/square. The conductive layer 12 can be any conductive material which is typically applied to paper such as quarternary ammonium salts, sulfonated polystyrenes, polyacrylic acid salts and the like. In addition, provided a reasonable amount of transparency is maintained, metallized films can also be employed.

A coating of a dielectric resin 14, i.e. a resin that has electrical insulating properties, is applied over the conductive coating 12. The dielectric resis coating thickness is less than about 15 micrometers and preferably, 4–5 micrometers and should adhere to the conductive substrate.

Dielectric resins suitable for use in either or both the dielectric substrate 10 or dielectric ocating 14 include polyvinyl acetates, acrylics, styrenated acrylics, polyesters, polyvinyl butyral, polycarbonates and other high dielectric resins.

In effect, by virtue of introducing the conductive layer 12, the capacitance of the substrate 10 is changed relative to a photoconductor 16 having a metallic substrate 18 and bearing an electrostatic latent image 20 formed thereon by conventional techniques. For the observer, however, the substrate 10 is virtually unchanged in thickness and transparency.

Because of the capacitative change provided by conductive layer 12 and dielectric coating 14, it has been found that the image 20 on the surface of photoconductor 16 can be transferred to the dielectric coating 14 on substrate 10 by bringing the photoconductor surface 16 into intimate contact with the surface of dielectric coating 14. The transferred electrostatic latent image 20' on dielectric coating 14 will have sufficiently high charge density to permit development by immersion of the dielectric imaging member in a bath of liquid developer 22 or by other conventional development techniques.

It should be understood that the process disclosed is not limited to charge transfer from a photoconductor. Any surface bearing an electrostatic latent image thereon, e.g., a dielectric surface which is corona charged and has a portion of the charge dissipated to form an electrostatic latent image or upon which an electrostatic latent image is formed by electrographic techniques can be transferred to the dielectric imaging member of this invention. Further, utilization of the present invention permits image transfer to any electrically insulative surface of a thickness which normally would have too small an electrical capacity to hold enough charge to produce sufficient development.

The improved dielectric film of the present invention can also be imaged by conventional electrographic techniques to provide sharp, dense images of the electrode configuration at reduced voltages and at significantly shorter pulse times.

The following examples further illustrate preferred embodiments of the present invention. These examples are included herein for illustrative purposes only and are not to be construed as imposing any limitations upon the scope of the invention. Unless otherwise stated, all percentages and parts are by weight.

EXAMPLE 1

Dielectric imaging members were prepared by coating a polyester substrate (Melinex 505 preprimed available from ICI) having a thickness of 100 micrometers with a conductive layer of sulfonated polystyrene obtained from National Starch. The surface conductivity was $10^{7}$ ohm-cm. The resulting conductive substrate was overcoated with a dielectric coating of styrenated acrylic from DeSoto, Inc. in thicknesses ranging from 1.4 to 14.2 micrometers. Thickness measurements were made using a recording spectrophotometer and by mechanical means. An electrostatic latent image was transferred to the resulting dielectric imaging member by intimate contact with an electrostatic latent image-bearing photoconductive plate which itself has been charged by a −5500 V corona. The 24 micrometer thick photoconductive plate had an initial surface voltage of 600 volts. The photoconductor composition was a charge transfer complex of polyvinyl carbazole and trinitrofluorenone, of the type disclosed in U.S. Pat. No. 3,484,237. The electrostatic latent image formed on the dielectric imaging member was developed by immersion in a liquid developer composition as disclosed in U.S. Pat. No. 3,542,682.

Measurements and calculations were made to determine the charge and voltage transferred to the dielectric imaging member from the photoconductive plate. The resulting measured voltage (Monroe Electrometer), calculated voltage, calculated charge and toner density are shown graphically as a function of thickness in the graphs of FIGS. 2 and 3.

It was found that as the thickness of the dielectric coating increased, the transferred voltage increased while the amount of transferred charge decreased. This follows from the principle of conservation of total charge which is that charge initially on the photoconductor is, on contact, shared between the photoconductor and the dielectric coating. As the dielectric coating thickness is increased, its capacity to hold charge is decreased relative to the photoconductor.

Optimum results of developed image density were observed when the thickness of the dielectric overcoating was in the range of 1.4–10 micrometers with maximum density occurring at a thickness of approximately 4–5 micrometers.

EXAMPLE 3

A high resolution microimaging system is provided when the dielectric imaging member of the present invention is used to receive an electrostatic latent image from a polyvinyl carbazole photoconductor sensitized with trinitrofluorenone. It has been found that an electrostatic positive charge image formed on such photoconductor can be transferred to the dielectric imaging member of the present invention with no externally applied voltage while maintaining the original resolution to greater than 100 line pairs per millimeter when developed.

The preferred microimaging system of the present invention as described above provides increased resolution by enabling the photoconductor to intimately contact the surface of the dielectric imaging member. Increased resolution is accomplished by transferring the electrostatic latent image under conditions wherein the two surfaces are in closest proximity. By using the surprisingly smooth surfaces afforded by both the polyvinyl carbazole-trinitrofluorenone photoconductor and dielectric imaging member of the present invention and low gap voltage, high resolution is obtained. Accordingly, the use of film-forming organic photoconductor such as polyvinyl carbazole is particularly advantageous.

A photoconductive plate was prepared by applying the coating composition identified below to a finely grained aluminum substrate:

| Ingredients | Amounts |
|---|---|
| polyvinyl carbazole | 9 grams |
| tetrahydrofuran | 60 ml. |
| 2,4,7-trinitro-9-fluorenone | 1 gram |
| Clorafin (a chlorinated hydrocarbon plasticizer available from Hercules Corporation) | 3 grams |

The mixture was applied by conventional means to the aluminum substrate with a resulting dry thickness of 20 micrometers. Both the adhension and apparent coating smoothness were enhanced by the addition of plasticizer.

The resulting photoconductive plate was charged using positive corona and imaged with tungsten light. The electrostatic latent image was transferred to dielectric imaging members prepared as described in Example 1 . The latent image was developed by immersion in negative liquid developer. The resulting resolution was greater than 100 line pairs per millimeter.

EXAMPLE 3

An electrographic imaging system was established by placing a dielectric imaging member prepared as described in Example 1 in contact with a grounded base electrode which was connected through a potential source to a stylus electrode. In this manner, positive high voltage (+ 800 V) was applied through the stylus to the dielectric imaging member for square wave pulse durations of $1.5 \times 10^{-5}$ to $1 \times 10^{-1}$ seconds. An electrostatic latent image was generated on the dielectric imaging member in the form of a circular charge pattern equivalent to the contact area of the stylus employed. The resulting electrostatic latent image was developed employing a negative liquid developer composition (Hunt negative electrostatic liquid toner available from Hunt Chemical).

Good sytlist images were thus obtained for applied pulse voltages of 450 to 800 volts at $5 \times 10^{-5}$ seconds pulse time.

Under identical conditions, no image was obtained when a conventional polyester film having a thickness of 75 micrometers was employed. When the pulse time was increased to 0.5 seconds, and the applied voltage to 1000 volts, some charge in the stylus area appeared, but only randomly.

What is claimed is:

1. An improved dielectric imaging member for receiving electrostatic latent images in the absence of an externally applied voltage so as to provide sharp density images consisting essentially of a transparent resin film substrate, a conductive layer on said substrate, and a dielectric resin film in which said dielectric film has a thickness in the range of about 1.4–10 micrometers on said conductive layer for receiving said latent images.

2. An improved dielectric imaging member in accordance with claim 1 in which said dielectric film has a thickness of about 4–5 micrometers.

3. An improved dielectric imaging member in accordance with claim 1 wherein said imaging member is transparent.

4. An improved dielectric imaging member in accordance with claim 1 wherein said conductive layer is an organic conductive layer.

5. An improved dielectric imaging member in accordance with claim 1 wherein said substrate had a thickness between about 75–175 micrometers and is selected from the group consisting of polyvinyl acetate, acrylics, styrenated acrylics, polyesters, polyvinyl butyral and polycarbonates.

* * * * *